US008522793B2

(12) United States Patent
Ohdaka et al.

(10) Patent No.: US 8,522,793 B2
(45) Date of Patent: Sep. 3, 2013

(54) FLASH DRYER FOR PARTICULATE MATERIALS

(75) Inventors: Yasuhiro Ohdaka, Tokyo (JP); Chihiro Hanaoka, Tokyo (JP); Nobuyasu Endo, Hiratsuka (JP); Akihiro Sugiyama, Hiratsuka (JP); Katsuhide Yokota, Hiratsuka (JP); Susumu Uchida, Hiratsuka (JP)

(73) Assignee: Japan Tobacco Inc., Tokyo (JP)

( * ) Notice: Subject to any disclaimer, the term of this patent is extended or adjusted under 35 U.S.C. 154(b) by 781 days.

(21) Appl. No.: 10/845,100

(22) Filed: May 14, 2004

(65) Prior Publication Data

US 2004/0205978 A1 Oct. 21, 2004

Related U.S. Application Data

(63) Continuation of application No. PCT/JP02/12274, filed on Nov. 25, 2002.

(30) Foreign Application Priority Data

Nov. 26, 2001 (JP) ..... 2001-359617
Jun. 28, 2002 (JP) ..... 2002-190447

(51) Int. Cl.
*A24B 5/00* (2006.01)

(52) U.S. Cl.
USPC ..... 131/304; 131/296; 131/303; 34/173; 34/484

(58) Field of Classification Search
USPC ..... 131/290, 296, 280, 342
See application file for complete search history.

(56) References Cited

U.S. PATENT DOCUMENTS

| | | | | | |
|---|---|---|---|---|---|
| 1,586,948 | A | * | 6/1926 | Connet | 73/861.49 |
| 1,680,274 | A | * | 8/1928 | Allen et al. | 34/173 |
| 3,409,025 | A | | 11/1968 | Wochnowski | |
| 3,678,939 | A | | 7/1972 | Key, III et al. | |
| 3,726,441 | A | * | 4/1973 | Keyes et al. | 222/626 |
| 3,905,123 | A | * | 9/1975 | Fowler et al. | 34/484 |
| 4,167,191 | A | * | 9/1979 | Jewell et al. | 131/303 |
| 4,366,825 | A | * | 1/1983 | Utsch et al. | 131/296 |
| 4,528,995 | A | | 7/1985 | Korte et al. | |
| 5,259,403 | A | | 11/1993 | Guy et al. | |
| 5,582,193 | A | * | 12/1996 | Fischer et al. | 131/296 |
| 5,908,032 | A | * | 6/1999 | Poindexter et al. | 131/291 |

FOREIGN PATENT DOCUMENTS

| | | | | |
|---|---|---|---|---|
| DE | 1532063 | A1 | | 1/1970 |
| EP | 0823220 | A1 | | 2/1998 |
| GB | 2176385 | A | * | 12/1986 |
| SU | 162461 | A | | 4/1964 |
| WO | WO 96/05742 | A1 | | 2/1996 |
| WO | WO 99/34696 | A1 | | 7/1999 |
| WO | WO 03/046453 | A1 | | 5/2003 |

* cited by examiner

*Primary Examiner* — Richard Crispino
*Assistant Examiner* — Phu Nguyen
(74) *Attorney, Agent, or Firm* — Birch Stewart Kolasch & Birch, LLP

(57) ABSTRACT

A flash dryer of cut tobacco comprises a drying duct (16) for connecting a feeding section (14) of cut tobacco to a tangential separator (18). The drying duct (16) has an upstream-side duct portion (16*a*) extending straight from the feeding section (14) at an elevation angle ranging from 30° to 60° and a downstream-side duct portion (16*b*) curving upward in a convex shape. A dry gas that flows through the drying duct (16) may contain superheated steam.

20 Claims, 5 Drawing Sheets

FLASH DRYER FOR PARTICULATE MATERIALS

This application is a Continuation of co-pending PCT International Application No. PCT/JP02/12274 filed on Nov. 25, 2002, which designated the United States, and on which priority is claimed under 35 U.S.C. §120, the entire contents of which are hereby incorporated by reference. This application also claims priority of Application No. 2001-359617 and 2002-190447 filed in Japan on Nov. 26, 2001 and Jun. 28, 2002, respectively, under 35 U.S.C. §119.

TECHNICAL FIELD

The present invention relates to a flash dryer for transferring a particulate material with a heated dry gas flow, and drying the particulate material using the dry gas flow in the transferring process, more specifically to a flash dryer suitable for drying fillers for cigarettes.

BACKGROUND ART

Fillers for cigarettes include cut tobacco obtained by cutting raw materials, such as leaf tobacco from which main ribs are removed, the main ribs and the reconstructed tobacco, separately or by mixture. Alternatively, the fillers include cut tobacco subjected to an expanding process. Both kinds of cut tobacco have the given grading, that is, size.

In such a cut tobacco-forming process, cut tobacco is generally subjected to a liquid flaver-adding process, namely a flavoring process, so that the cut tobacco, which has undergone this process, has a high moisture content. Therefore, after the flavoring process, the cut tobacco needs to be dried to contain the desired moisture content before being fed to a cigarette making machine. The cut tobacco subjected to the expansion process contains not only a high moisture content but also an impregnant (liquid carbon dioxide).

Utilized in the cut tobacco-drying process in general are a cylinder dryer or a flash dryer. The flash dryer is capable of drying the cut tobacco in a short period of time, compared to the cylinder dryer, so that it has high drying processibility and is suitable for improving the productivity of cigarettes.

A flash dryer of this type generally comprises a gas flow path through which a dry gas flows, and also includes an air blower, a heater, a cut tobacco-receiving section and a cut tobacco-separating section that are each disposed in the gas flow path in order from the upstream side of the gas flow path.

The cut tobacco fed through the receiving section into the gas flow path is transferred from the receiving section toward the separating section with a dry gas flow and dried in this transferring process. After being dried, the cut tobacco is separated from the dry gas flow in the separating section and taken out of the separating section.

In cases where the cut tobacco is subjected to the drying process, the cut tobacco must be dried evenly. When the drying of the cut tobacco is uneven, for instance, if the cut tobacco is overdried, the cut tobacco generates an irritating odor and loses its flavor and taste. As a result, the quality of the cigarettes is also deteriorated.

Since the cut tobacco is dried in the transferring process as described, there needs to be enough length of the gas flow path from the receiving section to the separating section, namely a drying flow path, for subjecting the cut tobacco to the drying process. This forces the drying flow path to be long. Therefore, the drying flow path has at least one flection, which saves space for installation of the drying flow path.

If there is a flection in the drying flow path, however, the cut tobacco is prone to be fractured when passing the flection. Moreover, the cut tobacco is liable to remain in the flection, and such remaining makes the drying of the cut tobacco uneven.

It is said that smoke, which is generated from the cut tobacco during the burning of cigarettes, contains toxic components. Therefore, if the flash drying of the cut tobacco reduces the toxic components contained in the smoke, the flash dryer is more suitable for drying the cut tobacco.

DISCLOSURE OF THE INVENTION

An object of this invention is to provide a flash dryer capable of reducing fracture of a particulate material to be subjected to a drying process and drying the particulate material evenly. If the particulate material is cut tobacco for cigarettes, an object of the invention is to provide a flash dryer capable of reducing toxic components contained in smoke which is generated from the cut tobacco, in addition to the above capabilities.

To attain the above objects, the flash dryer according to the present invention comprises a gas flow path, air-blowing means for producing a one-way dry gas flow in the gas flow path, the dry gas flow having a given temperature, a feeding section disposed in the gas flow path and being capable of feeding a particulate material to be subjected to a drying process into the gas flow path by means of the dry gas flow, the particulate material being transferred with the dry gas flow and dried in the transferring process, and a separating section located in the gas flow path, downstream from the feeding section, and separating the dried particulate material from the dry gas flow to discharge the material from the gas flow path, wherein the gas flow path includes a drying duct for connecting the feeding section to the separating section and leading the particulate material fed from the feeding section toward the separating section with the dry gas flow, the drying duct curving upward in a convex shape.

With the above-described flash dryer, since there is no flection in the drying duct, the particulate material, which has been supplied from the receiving section into the dry gas flow in the gas flow path, easily flows through the drying duct with the gas flow without remaining in the drying duct and is guided to the separating section. Consequently, the fracture of the particulate material is reduced, and the particulate material is evenly dried.

Specifically, the drying duct may includes an upstream-side duct portion extending straight upward from the feeding section and having a given elevation angle with respect to a horizontal plane, and a downstream-side duct portion smoothly connected the upstream-side duct portion and the separating section, respectively, and being formed in a curve with a given curvature radius. In this case, the upstream-side duct portion has an elevation angle in a range of from 30° to 60°.

According to the drying duct, the particulate material supplied into the drying duct is blown up at a steep angle with the dry gas flow in the upstream-side duct portion. At this moment, the particulate material is dispersed well in the dry gas, which promotes the even drying of the particulate material.

The feeding section includes a venturi duct, which is connected to the drying duct and has a throat and a downstream portion linearly continuing to the upstream-side duct portion of the drying duct, and a rotary feeder for supplying the particulate material into the venturi duct at a feeding position which is defined immediately downstream of the throat. It is preferable that the venturi duct and the drying duct each have a rectangular flow-path cross section along the longitudinal direction thereof, and that the flow-path cross section of the venturi duct have width which is constant along the longitudinal direction thereof.

According to the above-described feeding section, since the width of the flow-path cross section of the venturi duct is constant along the longitudinal direction of the venturi duct, flux of the dry gas flow in the venturi duct is squeezed at the throat only heightwise, and the flux of the dry gas diverges toward the drying duct. Therefore, the dry gas flow does not form an eddy in the venturi duct, and the particulate material supplied into the venturi duct is dispersed well in the diverging dry gas immediately downstream of the throat and then directed to the drying duct without remaining.

More specifically, the throat is defined in between a part of a bottom wall and a part of a top wall of the venturi duct, and the part of the top wall is formed in the shape of a substantial V in a longitudinal section thereof. It is desirable in this case that the bottom wall of the venturi duct have a downstream-side bottom portion having a substantial V-shape in a longitudinal section thereof at the downstream side of the throat. The downstream-side bottom portion defines a deep region that temporarily increases a cross-sectional area of the flow path of the venturi duct. Alternatively, the bottom wall of the venturi duct may extend straight.

According to the above-described venturi duct, the dry gas flow, which has passed through the throat, proceeds away from the feeding position, so that the particulate material can be smoothly supplied from the rotary feeder into the venturi duct. Since the cross-sectional area of the flow path of the venturi duct is widened downstream of the throat, the particulate material is dispersed well in the venturi duct.

If there is provided the deep region downstream of the throat, more favorable supplying and dispersion of the particulate material can be achieved.

Concerning the cross-sectional area of the flow path of the venturi duct, the increasing rate of the cross-sectional area of the flow path located downstream of the throat is limited to the range in which the dry gas flow is not detached from an inner wall of the venturi duct. The detachment of the dry gas flow creates an eddy in the dry gas flow in the venturi duct, and such an eddy causes remaining of the particulate material in the venturi duct. In the venturi duct of the present invention, however, there generates no eddy of the dry gas flow that causes the remaining of the particulate material.

The separating section is provided with a tangential separator having a horizontal axis, the tangential separator including a cylindrical separator housing and a rotary feeder. More specifically, the separator housing has an inlet located in a top portion of outer periphery of the separator housing, being open in a horizontal direction, and guides the particulate material with the dry gas flow from the drying duct, an outlet located in a bottom portion of the outer periphery of the separator housing, being open downward, and discharges the particulate material from the separator housing, an exhaust port formed in an end face of the separator housing, being open eccentrically with respect to the horizontal axis, and discharges the dry gas from the separator housing, and a pair of linear wall portions forming the bottom portion of the outer periphery of the separator housing and facing each other so as to converge toward the outlet. In this case, the rotary feeder is connected to the outlet of the separator housing and takes out the particulate material from the separator housing through the outlet.

According to the above-described separating section, the particulate material, which has flowed from the inlet of the separator housing into the housing with the dry gas flow, moves from the inner wall of the separator housing along one of the linear wall portions toward the outlet, while the dry gas flow in the separator housing is deflected in the direction to the exhaust port. More specifically, the dry gas flow that has transferred the particulate material to one of the linear wall portions is detached from the linear wall portion to collide with the other linear wall portion. Thereafter, the dry gas flow runs upward along the other linear wall portion, heading for the exhaust port. Thus, the particulate material is smoothly led from the first-mentioned linear wall portion to the outlet and taken out from the outlet through the rotary feeder without remaining in the separator housing. As a consequence, the particulate material passes through the drying duct and the tangential separator within a given time period so that the particulate material is subjected to the even drying process.

It is possible to increase or decrease the width of a portion of the drying duct, that is in the vicinity of the inlet. In this case, the velocity of the dry gas that flows into the tangential separator is changed, so that the particulate material is dispersed well in the tangential separator.

The separating section may further include chutes in plural tiers under the rotary feeder. These chutes are aligned in a vertical direction at given intervals, and the particulate material taken out from the rotary feeder passes through the chutes sequentially while drawing in outside air from between the chutes. Such drawing of outside air promotes cooling of the particulate material.

When the particulate material to be dried is cut tobacco for cigarettes, the dry gas may contain superheated steam. In this case, to bring the moisture content of the dried cut tobacco into the range of from 9 to 14 weight percent, it is preferable that the dry gas have a drying temperature in the range of from 160 to 260° C. and absolute humidity in the range of from 2.4 to 11.8 kg/kg. To bring the moisture content of the dried cut tobacco into the range of from 12 to 14 weight percent, it is desirable that the dry gas have a drying temperature in the range of from 160 to 190° C. and absolute humidity in the range of from 2.4 to 11.8 kg/kg.

If the cut tobacco is dried on the aforementioned drying conditions, the superheated steam in the dry gas flow reduces components, such as tobacco-specific nitrosamines, phenols, pyridine, quinoline, styrene, and aromatic amines, among components contained in a mainstream smoke of cigarettes.

On the other hand, when the cut tobacco impregnated with an impregnant, or liquid carbon dioxide, is subjected to the drying process as a particulate material, the dry gas is not particularly required to contain the superheated steam. If the dry gas contains the superheated steam, it is preferable that the dry gas have a drying temperature in the range of from 250 to 380° C. and absolute humidity in the range of from 2.4 to 11.8 kg/kg in order to bring the moisture content of the dried cut tobacco into the range of from 2 to 9 weight percent. On the contrary, if the dry gas contains no superheated steam, it is desirable that the dry gas have a drying temperature in the range of from 200 to 300° C. to bring the moisture content of the dried cut tobacco into the range of from 9 to 12 weight percent.

In addition, when the dry gas contains the superheated steam, it is preferable that the gas flow path form a circulation passage for the dry gas, and that the flash dryer further comprise exhaust means for discharging at least 10 percent of flow rate of the dry gas from the circulation passage. If part of the dry gas is discharged during the circulation of the dry gas in this manner, the dry gas flow running through the drying duct can contain fresh superheated steam, whereby the effect of reducing the above-mentioned components can be retained.

BEST MODE OF CARRYING OUT THE INVENTION

Figure 1:
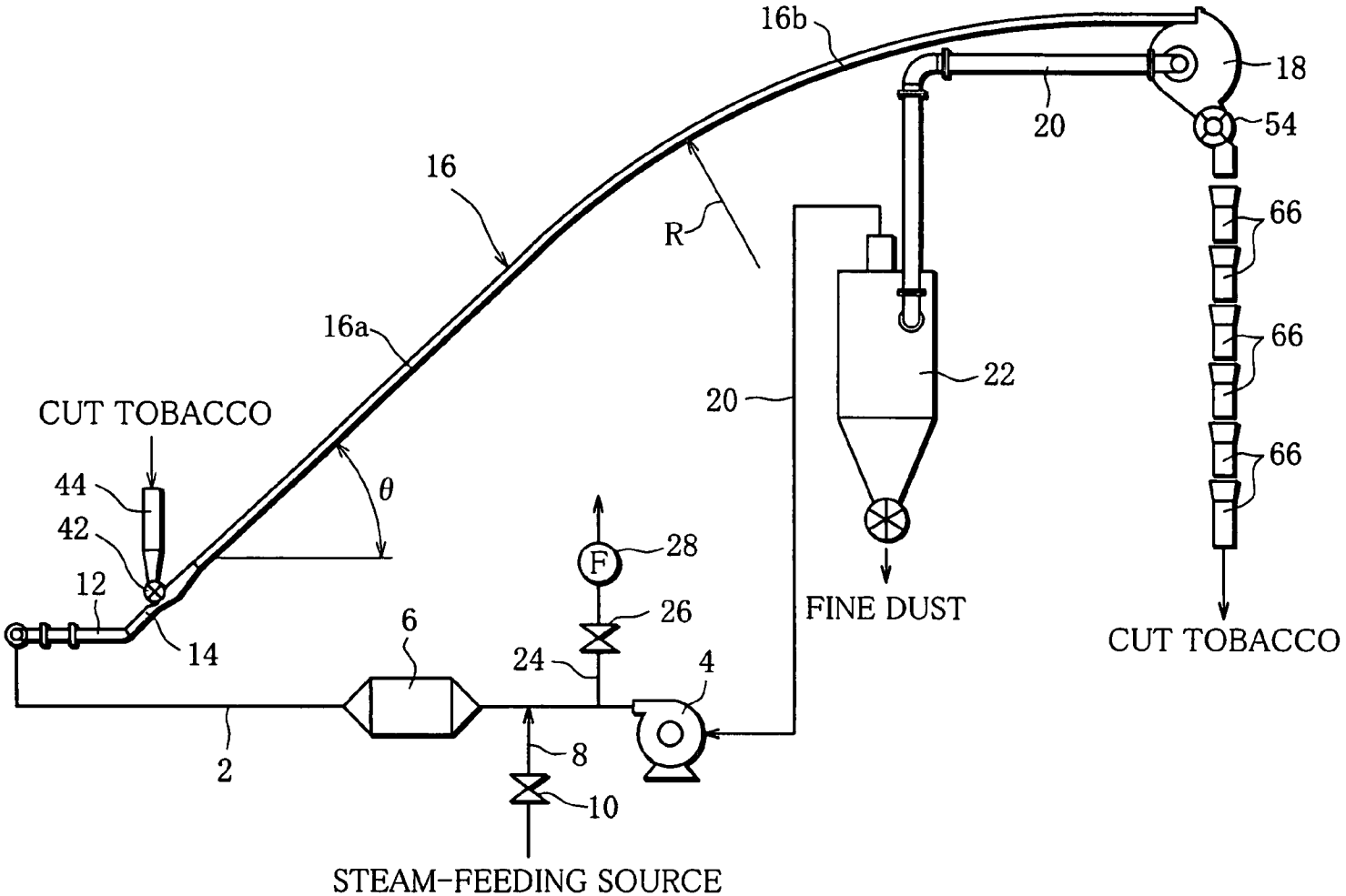
FIG. 1 is a view showing a schematic structure of a flash dryer.

FIG. 1 schematically shows a flash dryer for use in a drying process of cut tobacco as a particulate material.

The flash dryer has a gas flow path 2, in which a circulation fan 4 and a heater 6 are disposed in order. The circulation fan 4 sends gas such as air toward the heater 6. The heater 6 heats the gas up to a given temperature, more specifically in the range of from 160 to 300° C., preferably from 180 to 260° C.

A steam-feeding pipe 8 extends from a portion of the gas flow path 2, that is located in between the circulation fan 4 and the heater 6. The steam-feeding pipe 8 is connected to a steam-feeding source. There is disposed a steam-feeding valve 10 in the steam-feeding pipe 8. When the steam-feeding valve 10 is opened, steam is supplied from the steam-feeding source through the steam-feeding pipe 8 to the gas in the gas flow path 2. This produces a dry gas flow that contains superheated steam in the gas flow path 2. In this case, temperature of the dry gas flow is in the range of from 160 to 190° C., and absolute humidity thereof is in the range of from 2.4 to 11.8 kg/kg.

The gas flow path 2 has a horizontal duct 12, which is disposed downstream of the heater 6. The horizontal duct 12 is connected to a receiving section 14, and the cut tobacco as a particulate material is fed from the receiving section 14 into the gas flow path 2.

Extended from the receiving section 14 is a drying duct 16, which is connected to a tangential separator 18 serving as a separating section. The drying duct 16 forms a part of the gas flow path 2, or a drying flow path.

As is obvious from FIG. 1, the drying duct 16 curves upward in a convex shape viewed as a whole and smoothly connects the receiving section 14 to the tangential separator 18.

Accordingly, the dry gas in the gas flow path 2 runs through the receiving section 14 into the drying duct 16, and a velocity rate of the dry gas at this moment is in the range of from 13 to 40 m/s.

There is provided a return flow path 20 extending from an exhaust port of the tangential separator 18, the return flow path 20 is connected to the circulation fan 4. There is disposed a cyclone separator 22 in the return flow path 20.

An exhaust pipe 24 branches from the gas flow path 2 and extends from between the circulation fan 4 and a steam-connecting pipe 8. In the exhaust pipe 24, there are disposed an exhaust control valve 26 and an exhaust fan 28 in order. The exhaust fan 28 extracts at least 10 percent of flow rate of the dry gas flow running through the gas flow path 2 to the exhaust pipe 24 and discharges the same.

The drying duct 16 has an upstream-side duct portion 16*a* and a downstream-side duct portion 16*b* with in a flowing direction of the dry gas flow. The upstream-side duct portion 16*a* is connected to the receiving section 14, and the downstream-side duct portion 16*b* to the tangential separator 18.

Figure 2:
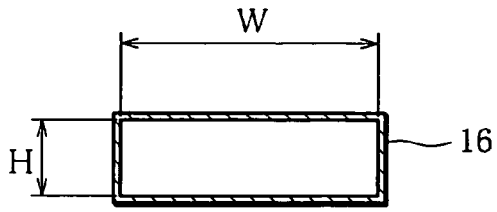
FIG. 2 is a cross sectional view of a drying duct.

As illustrated in FIG. 2, the drying duct 16 has a rectangular flow-path cross section. The flow-path cross-sectional area may be either constant along the longitudinal direction of the drying duct 16 or varied. When the height and width of the flow-path cross section are indicated by H and W, respectively, the ratio of height H to width W, namely R(=H/W), is 1 or less.

The upstream-side duct portion 16*a* is a single upstream-side duct portion 16*b* which extends substantially straight in the upward sloping direction. More specifically, an angle between a horizontal plane and the upstream-side duct portion 16, or elevation angle θ, is in the range of from 30 degrees to 60 degrees. The downstream-side duct portion 16*b* is a single downstream-side duct portion 16*b* which curves upward in a convex shape. Ends of the single downstream-side duct portion 16*b* are smoothly, or tangentially, and directly connected to an upper end of the upstream-side duct portion 16*a* and directly connected to a horizontally extending inlet 50 of the tangential separator 18, respectively. The single downstream-side duct portion 16*b* has a curvature radius R in the range of from 6 to 20 m, and a length of the drying duct 16 from a starting end thereof to an outlet of the tangential separator 18 is in the range of from 8 to 15 m. The horizontally extending inlet 50 of the tangential separator 18 is located in a position at a higher level than a single downstream end of the upstream-side duct portion 16*a*. In addition, the single downstream-side duct portion 16*b* of said duct portion 16 curves in a convex shape so that a curvature from the upstream end of the downstream-side duct portion 16*b* to the downstream end of the downstream-side duct portion 16*b* is limited to an angle that is substantially equal to the elevation angle θ.

Figure 3:
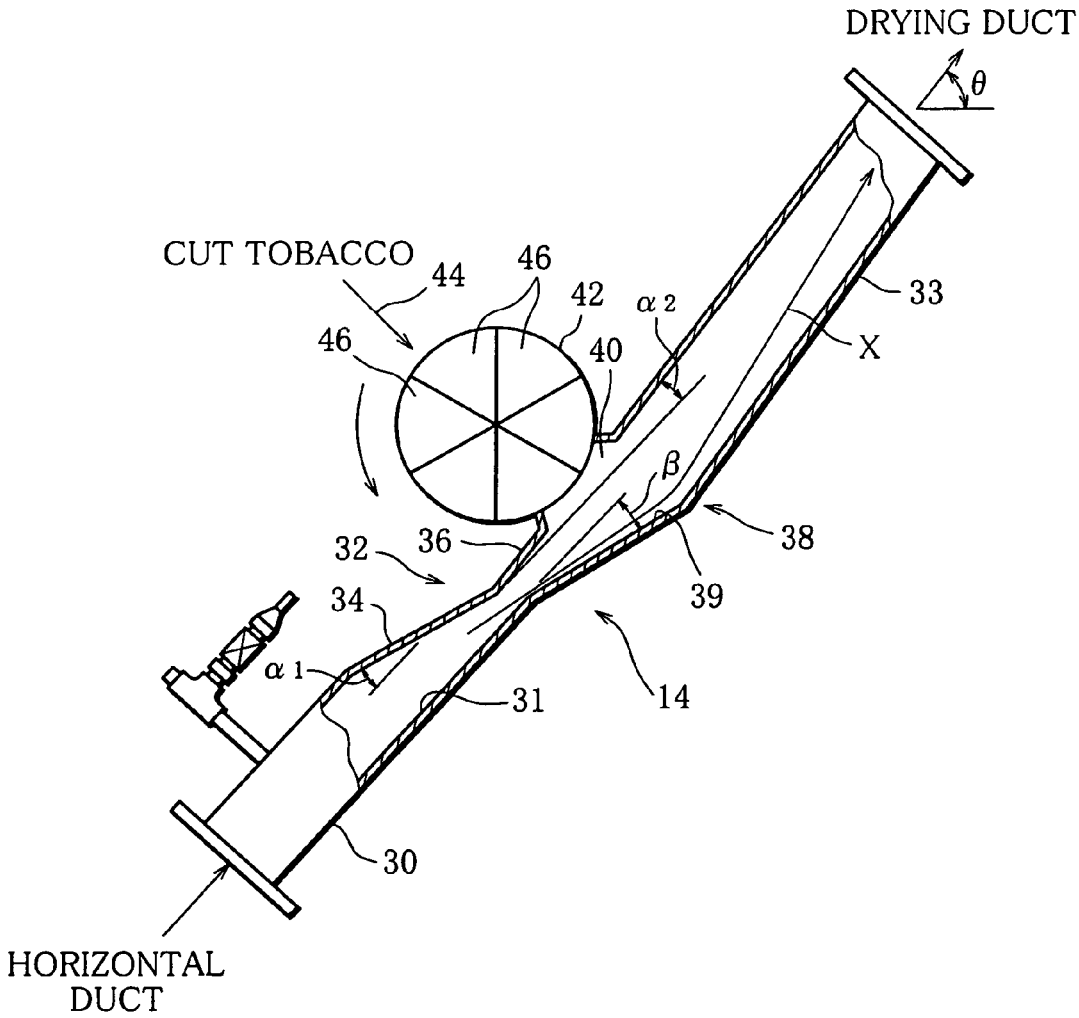
FIG. 3 is a cross sectional view of a receiving section according to one embodiment.

FIG. 3 shows the receiving section 14 in detail.

The receiving section 14 comprises a venturi duct 30, which connects the horizontal duct 12 to the drying duct 16 or the upstream-side duct portion 16*a*. A flow-path cross section of the venturi duct 30 is rectangular as well as that of the drying duct 16, and width of the flow-path cross section is constant in the flowing direction of the dry gas flow.

The venturi duct 30 has a throat 32. When the dry gas passes through the throat 32, the flow velocity of the dry gas is increased. More specifically, the flow velocity of the dry gas passing through the throat 32 is higher than that of the dry gas running through the drying duct 16.

The throat 32 is formed by caving a part of a top wall of the venturi duct 30 and includes an upstream-side top portion 34 and a downstream-side top portion 36. The top portions 34 and 36 form a substantial V-shape in a longitudinal section of the venturi duct 30. That is, the upstream-side top portion 34 is slanted toward a bottom wall of the venturi duct 30, whereas the downstream-side top portion 36 is inclined in a direction getting away from the bottom wall side of the venturi duct 30 to extend to the drying duct 16.

The bottom wall of the venturi duct 30 includes an upstream-side bottom portion 31 and a downstream-side bottom portion 33. The upstream-side bottom portion 31 extends straight from the horizontal duct 12 to the throat 32, that is, a location where the flow-path cross-sectional area of the venturi duct 30 is minimum. Oblique angles $\alpha_1$ and $\alpha_2$ formed by the top portions 34 and 36 with respect to the upstream-side bottom portion 31 are each in the range of from 2° to 20°. It is preferable that the oblique angle $\alpha_1$ be larger than the oblique angle $\alpha_2$, whereby the flow-path cross-sectional area of the venturi duct 30 is sharply decreased up to the throat 32 and then gradually increased from the throat 32.

The downstream-side bottom portion 33 of the venturi duct 30 is formed in the shape of a substantial V in the longitudinal section of the venturi duct 30. In other words, the downstream-side bottom portion 33 has a deep region 38 downstream of the throat 32. Therefore, after being decreased temporarily at the throat 32, the flow-path cross-sectional area of the venturi duct 32 is increased by degrees toward the deep region 38 located downstream of the throat 32 and gradually decreased from the deep region 38 toward the drying duct 16.

The downstream-side bottom portion 33 has an inclined surface 39 extending from the throat 32 to the deep region 38. An oblique angle β formed by the inclined surface 39 with respect to the upstream-side bottom portion 31 is identical to the oblique angle $\alpha_1$ of the upstream-side top portion 34. Accordingly, the inclined surface 39 and the upstream-side top portion 34 are parallel to each other. This means that the dry gas flow, which has passed through the throat 32, proceeds without being detached from the inclined face 39. That is, concerning the flow-path cross-sectional area of the venturi duct 30, an increasing rate of the cross-sectional area of the flow path downstream from the throat 32 is so set as not to detach the dry gas flow from the bottom wall of the venturi duct 30.

The downstream-side top portion 36 of the venturi duct 30 has the same elevation angle as the upstream-side duct portion 16*a* of the drying duct 16.

Additionally, the horizontal duct 12 may have either a rectangular flow-path cross section as well as the venturi duct 30 or a circular flow-path cross section.

There is formed a feed port 40 being open in the downstream-side top portion 36 of the venturi duct 30, and the feed port 40 is located immediately downstream of the throat 32. An outlet of the rotary feeder 42 is directly connected to the feed port 40, and an inlet of the rotary feeder 42 is connected to a feeding line 44 of cut tobacco.

The rotary feeder 42 includes a cylindrical casing and a rotor rotatably located in the casing, the rotor having a plurality of pockets 46 on an outer peripheral surface thereof. The pockets 46 are arranged at regular intervals in a circumferential direction of the rotor. When the rotor isrotated, one of the pockets 46 is connected to the inlet of the rotary feeder 42 or the housing thereof. At this moment, the pocket 46 receives cut tobacco from the feeding line 44. Thereafter, the received cut tobacco is transferred with the rotation of the rotor toward the outlet of the housing along with the pocket 46. When the pocket 46 coincides with the outlet, the cut tobacco in the pocket 46 is supplied into the venturi duct 30 through the feed port 44.

The rotor of the rotary feeder 42 is rotated counterclockwise direction as viewed in FIG. 3. Accordingly, when each of the pockets 46 passes through the outlet of the housing, a transferring direction of the pocket 46 coincides with a flowing direction of the dry gas flow in the venturi duct 30.

In this case, the cut tobacco fed to the rotary feeder 42 is to be subjected to an expansion process by means of flash drying, and has a high moisture content. Specifically, the moisture content of the cut tobacco is adjusted to the range of from 17 to 35 weight percent, preferably from 18 to 25 weight percent.

Figure 4:
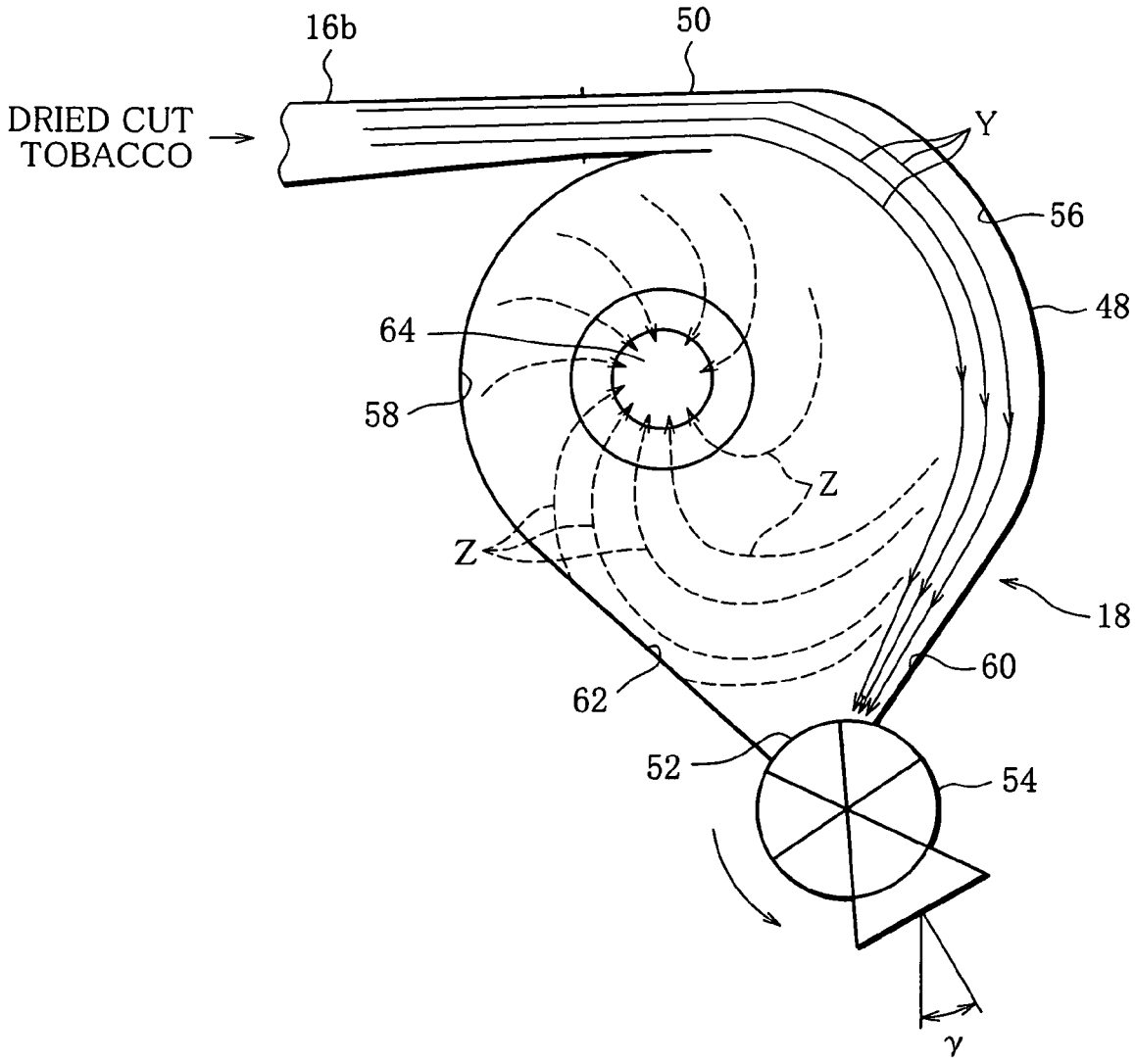
FIG. 4 is a longitudinal sectional view of a tangential separator.

FIG. 4 shows the tangential separator 18.

The tangential separator 18 comprises a cylindrical separator housing 48, which has a horizontal axis and an inlet 50. The inlet 50 is located in the top portion of an outer periphery of the separator housing 48 and protrudes in a tangential direction to the outer periphery of the separator housing 48, that is, in the horizontal direction. The inlet 50 is smoothly connected to a downstream end of the downstream-side duct portion 16*b* of the drying duct 16. Therefore, the inlet 50 also has a rectangular flow-path cross section, and the thickness of the separator housing 48 along the horizontal axis is identical to the width of the drying duct 16.

As is clear from FIG. 4, the downstream end of the downstream-side duct portion 16*b* has a bottom inclined upward in a direction to the inlet 50.

The separator housing 48 further has an outlet 52, which is located in the bottom portion of the outer periphery of the separator housing 48. The outlet 52 is directly connected to an inlet of a rotary feeder 54 which is similar to the rotary feeder 42.

The separator housing 48 includes a peripheral wall including a guide wall 56 in the shape of a circular arc, that extends from the inlet 50 to the outlet 52, and a guide wall 58 in the shape of a circular arc, that extends from the outlet 52 to the inlet 50 in an inflow direction of the dry gas flow from the inlet 50. The guide walls 56 and 58 have linear wall portions 60 and 62 in lower portions thereof, respectively. The linear wall portions 60 and 62 are located away from each other in the rotating direction of the rotary feeder 54 and extend toward the outlet 52 convergently. As is apparent from FIG. 4, the outlet 52 has an axis inclined at a given angle γ (for example, γ=0° to 30°) with respect to a vertical plane. Therefore, the rotary feeder 54 is also connected to the outlet 52 while being inclined.

One end wall of the separator housing 48 has an exhaust port 64, which is connected to the return pipe 20. As is obvious from FIG. 4, the exhaust port 64 is located closer to the guide wall 58 than to the guide wall 56 and closer to the inlet 50 than to the outlet 52. The separator housing 48 may be provided with the exhaust port 64 in each of the end walls thereof. In this case, both the exhaust openings 64 are each connected to the return pipe 20.

As illustrated in FIG. 1, a plurality of chutes 66 are arranged in a line in the vertical direction under the outlet of the rotary feeder 54. Each of the chutes 66 has a hopper-like upper end, and there is assured a given space between two vertically adjacent chutes 66.

Operation of the flash dryer will be described below.

Once the dry gas flow is led into the venturi duct 30, the dry gas flow is directed upward in the venturi duct 30. At this moment, flux of the dry gas flow is squeezed toward the throat 32, and the dry gas flow then passes through the throat 32 while the flow velocity thereof is increased.

As mentioned before, the venturi duct 30 has the flow-path cross section that is constant along the longitudinal direction of the venturi duct 30, and the deep region 38 located downstream of the throat 32 temporarily increases the flow-path cross section of the venturi duct 30. In other words, the upstream-side top portion 34 of the throat 32 and the inclined face 39 forming the deep region 38 are parallel to each other. Therefore, the dry gas flow that has passed through the throat 32, as shown by arrow X in FIG. 3, proceeds largely to the deep region 38 and is thereafter returned from the deep region 38 toward the center of the venturi duct 30 to be led to the drying duct 16.

Accordingly, after passing through the throat 32, the dry gas flow proceeds away from the feed port 40, so that the dry gas flow never hinders the supply of the cut tobacco from the feed port 40 into the venturi duct 30. As a consequence, the cut tobacco is easily fed into the venturi duct 30.

The flow path of the venturi duct 30 located downstream from the throat 32 is not bent at the deep region 38. Therefore, the cut tobacco supplied from the feed port 40 does not remain in the deep region 38. After being dispersed well in the deep region 38, the cut tobacco is returned to the center of the venturi duct 30, which prevents the cut tobacco from being led to the drying duct 16 in masses.

Moreover, the venturi duct 30 includes a downstream portion having an elevation angle θ identical to the elevation angle of the drying duct 16, and this generates a sharp rise of the dry gas flow in the venturi duct 30. Such an ascendent flow of the dry gas further promotes the dispersion of the cut tobacco.

Thereafter, the cut tobacco is led along with the dry gas flow from the venturi duct 30 into the drying duct 16. The upstream-side duct portion 16*a* of the drying duct 16 is formed in a straight line, whereas the downstream duct portion 16*b* is formed in the shape of a moderate circular arc, so that the drying duct 16 has no flection. Thus, the cut tobacco smoothly runs through the drying duct 16 along with the dry gas flow as it is evenly dispersed in the drying duct 16. This means that the cut tobacco is led to the tangential separator 18 without remaining in the drying duct 16, and that the time required for the cut tobacco to pass through the drying duct 16 is substantially constant.

Consequently, when passing through the drying duct 16, the cut tobacco, which is evenly dispersed in the drying duct 16, is brought into satisfactory contact to the dry gas flow at a whole surface thereof, and moreover the time required to pass through the drying duct 16 is substantially constant, so that the cut tobacco can be evenly dried in the drying duct 16. As a result, the cut tobacco is prevented from being overdried or deficiently dried, which enables an even drying process of the cut tobacco and avoids a deterioration in flavor and taste of the cut tobacco.

Since the flow-path cross-sectional area of the drying duct 16 is constant along the longitudinal direction of the drying duct 16 as described above, when the cut tobacco passes through the drying duct 16, collision of the cut tobacco against an inner wall of the drying duct 16 is suppressed. Therefore, even if the particulate material to be dried is cut tobacco that is relatively prone to be fractured, the cut tobacco is prevented from being fractured, and the quality of the drying-processed cut tobacco is improved. In addition, the cut tobacco expanded by the drying process and the cut tobacco obtained by cutting reconstructed tobacco sheets are especially liable to be fractured.

Thereafter, the dried cut tobacco is led with the dry gas flow into the inlet 50 of the tangential separator 18. Since the inlet 50 tangentially protrudes from the outer periphery of the separator housing 48, the cut tobacco can flow into the separator housing 48 through the inlet 50 without difficulty. That is, the cut tobacco flows toward the outlet 52 while being smoothly guided along the guide wall 56 as shown by arrows Y in FIG. 4. As a result, the cut tobacco never collides violently against the guide wall 56 of the separator housing 48.

Air is discharged from the separator housing 48 through the exhaust port 64. The discharge of air produces in the separator housing 48 a spiral flow shown by dashed lines Z in FIG. 4 in cooperation with the dry gas flow that flows in from the inlet 50, and the spiral flow advances toward the exhaust port 64. Such a spiral flow acts to separate the dry gas flow, which tends to run along the guide wall 56, from the guide wall 56. The dry gas flow then collides with the linear wall portion 62 continuing to the outlet 52 and proceeds toward the exhaust port 64.

Once the cut tobacco that runs along the guide wall 56 reaches the linear wall portion 60 continuing to the outlet 52, the cut tobacco is substantially detached from the dry gas flow. Thereafter, the cut tobacco smoothly flows downward while being guided along the linear wall portion 60, and is discharged from the outlet 52 through the rotary feeder 54. Accordingly, the cut tobacco does not remain in the separator housing 48, and the time required for the cut tobacco to pass through the tangential separator 18 becomes constant, thereby averting the overheating of the cut tobacco in the tangential separator 18.

Consequently, the time required for the cut tobacco that has been fed by the feeding section 14 to be discharged from the tangential separator 18, namely a total drying time of the cut tobacco, becomes constant, thereby securing the even drying process of the cut tobacco.

Specifically, in the case of the flash dryer, the total drying time of the cut tobacco is in the range of from 0.5 to 1.8 sec. This means that the cut tobacco does not remain in the flash dryer and that the overheating of the cut tobacco is prevented.

The moisture content of the cut tobacco discharged from the tangential separator 18 is in the range of from 9 to 14 weight percent, preferably from 12 to 14 weight percent. The cut tobacco is rapidly reduced in moisture content.

When the cut tobacco is quickly dried in the above manner, the moisture contained in the cut tobacco is rapidly vaporized. Such vaporization of the moisture curls the cut tobacco, which makes the dried cut tobacco into so-called curling cut tobacco. Such curling cut tobacco has a high expansion volume, so that it is possible to reduce a filling density of the cut tobacco in a cigarette.

The cut tobacco discharged from the outlet of the rotary feeder 54 falls, sequentially passing the chutes 66 formed in tiers. At this moment, the falling of the cut tobacco draws outside air from between the two vertically adjacent chutes 66 into the chute 66 at a lower side, so that the cut tobacco is satisfactorily cooled by the outside air, which prevents a deterioration in flavor and taste of the cut tobacco.

The dry gas flow in the separator housing 48 is discharged from the exhaust port 64 and passes through the cyclone separator 22. At this moment, the cyclone separator 22 removes fine dust of the cut tobacco and the like from the dry gas flow.

Using the cut tobacco dried by the flash dryer, object cigarettes A, B and C were produced. At the same time, using the cut tobacco dried by a general cylinder dryer, comparative cigarettes corresponding to the object cigarettes A, B and C were produced. Contents of components contained in a mainstream smoke produced by these cigarettes were measured, and a result of comparison as to the contents of some components was obtained as shown in TABLE 1. The result of the comparison shown in TABLE 1 indicates a decreasing rate of contents of components contained in smoke of the object cigarettes based on the respective comparative cigarettes.

TABLE 1

| COMPONENTS IN SMOKE | DETAILED CLASSIFICATION | OBJ. CIGARETTE A (%) | OBJ. CIGARETTE B (%) | OBJ. CIGARETTE C (%) |
|---|---|---|---|---|
| Tobacco-specific Nitrosamines | NNN | −2.20 | 16.20 | 12.00 |
| | NAT | 3.30 | 7.60 | 3.90 |
| | NAB | 22.40 | 12.10 | — |
| | NNK | 22.40 | 1.20 | 7.40 |
| Phenols | Hydroquinone | 10.50 | 10.90 | 9.80 |
| | Resorcinol | 8.60 | 9.80 | 5.50 |
| | Catechol | 12.00 | 9.50 | 8.20 |
| | Phenol | 17.20 | 16.70 | 10.90 |
| | m-Cresol + p-Cresol | 13.50 | 15.20 | 10.70 |
| | o-Cresol | 10.40 | 16.10 | 11.20 |
| | Pyridine | 5.00 | 4.50 | 3.00 |
| | Quinoline | 13.00 | 8.20 | 7.20 |
| | Styrene | 0.00 | 0.60 | 0.50 |
| Aromatic amines | 1-Aminonaphthalene | 9.80 | 10.30 | 18.00 |
| | 2-Aminonaphthalene | 8.40 | 8.30 | 18.30 |
| | 3-Aminobiphenyl | 8.00 | 8.00 | 13.90 |
| | 4-Aminobiphenyl | 6.70 | 8.20 | 11.80 |

In TABLE 1, NNN represents nitrosonornicotine, NAT nitrosoanatabine, NAB nitrosoanabasine, and NNK 4-N-nitrosomethylamino-1-3-pyridyl-1-butanone.

The cut tobacco of the object cigarettes A, B and C is processed with the above-described flash dryer on the following drying conditions.

Temperature of the dry gas flow: 160-190° C.

Velocity of the dry gas flow: 17 m/s

Absolute humidity of the dry gas flow: 5.6 kg/kg

Exhaust ratio of flow rate of the dry gas flow: 50%

Moisture content of the cut tobacco before drying: 20 wt %

Moisture content of the dried cut tobacco: 13 wt %

Feeding flow rate of the cut tobacco before drying: 80 kg/h

The cut tobacco of the object cigarettes A and C includes plural kinds of fillers, and these fillers are subjected to the drying process in a lump. The cut tobacco of the object cigarette B also includes plural kinds of fillers, and the fillers are individually subjected to the drying process. More specifically, the object cigarettes A and B are "Mild Seven" (trademark), and the object cigarette C is "Hi-lite" (trademark).

The cut tobacco of the comparative cigarettes is subjected to the drying process using a general cylinder dryer. Drying conditions of the cylinder dryer are as follows:

Heating temperature of the cylinder wall: 120° C.

Temperature of the heated air: 60° C.

Absolute humidity of the heated air: 0.1 kg/kg or less

Exhaust rate of the heated air: 20%

As is obvious from TABLE 1, the cut tobacco of the object cigarettes A, B and C is substantially reduced in contents of the components, such as tobacco-specific nitrosamines, phenols, pyridine, quinoline, styrene, and aromatic amines, that are contained in the mainstream smoke, compared to the cut tobacco of the comparative cigarettes. One possible reason for this is that the cut tobacco is dried not by the heated air but by the dry gas flow.

It is possible to further reduce the moisture content of the dried cut tobacco to 9 weight percent by raising the temperature of the dry gas up to 260° C.

Figure 6:
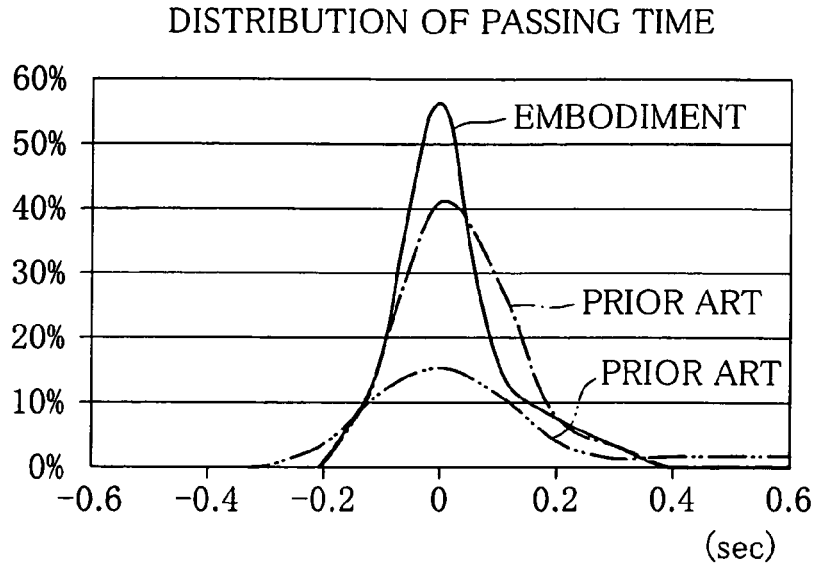
FIG. 6 is a graph showing distribution of passing time of cut tobacco when the cut tobacco as a particulate material passes through the flash dryer.

A solid line in FIG. 6 shows distribution of time required for the cut tobacco that has been fed from the receiving section 14 to be discharged from the tangential separator 18, that is, distribution of time required for the cut tobacco to pass through the flash dryer of the present embodiment. Moreover, a dashed line and a double-dashed line in FIG. 6 indicate the distribution of time for the cut tobacco to pass through the conventional flash dryer.

As is apparent from FIG. 6, in the case of the flash dryer of the embodiment, variation of passing time of the cut tobacco ranges within ±0.2 sec. This proves that the cut tobacco is evenly dried. The conventional flash dryer having a characteristic shown by the dashed line includes a C-shaped drying duct, and the conventional one having a characteristic shown by the double-dashed line includes an S-shaped drying duct.

Figure 7:
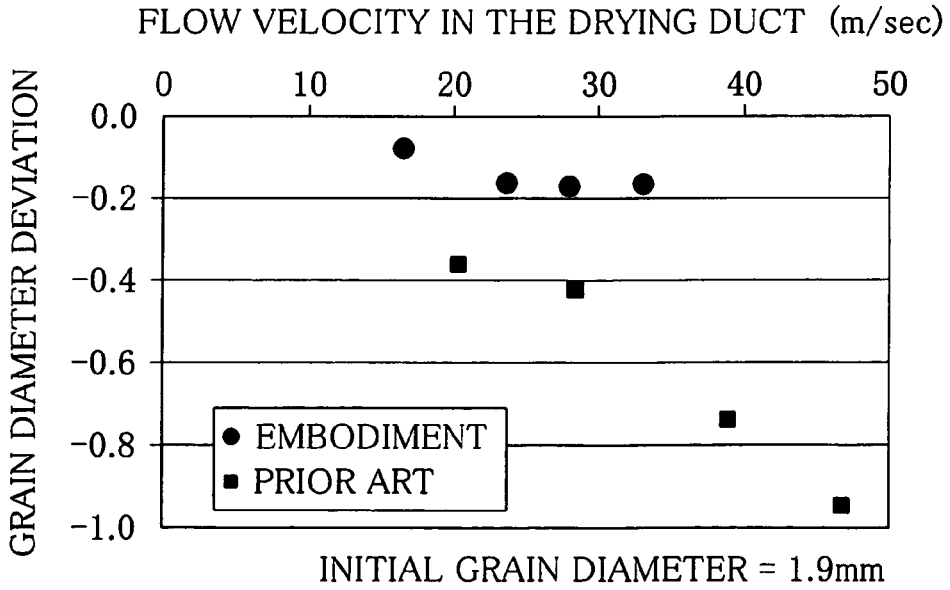
FIG. 7 is a graph showing a fracture degree of the cut tobacco with respect to the flow velocity of a dry gas in the drying duct.

Furthermore, FIG. 7 shows a fracture rate of the cut tobacco with respect to the flow velocity of the dry gas in the drying duct. In this case, the fracture rate of the cut tobacco is indicated by deviation between an initial grain diameter (1.9 mm) of the cut tobacco fed from the receiving section 14 and a grain diameter of the cut tobacco discharged from the tangential separator 18. As is evident from FIG. 7, according to the flash dryer of the embodiment, even if the flow velocity of the dry gas is increased, the grain diameter deviation of the cut tobacco is not much increased. On the contrary, in the case of the conventional flash dryer, the greater the flow velocity of the dry gas is, the larger the grain diameter deviation of the cut tobacco is.

The present invention is not limited to the above-described embodiment, but may be modified in various ways.

Figure 5:
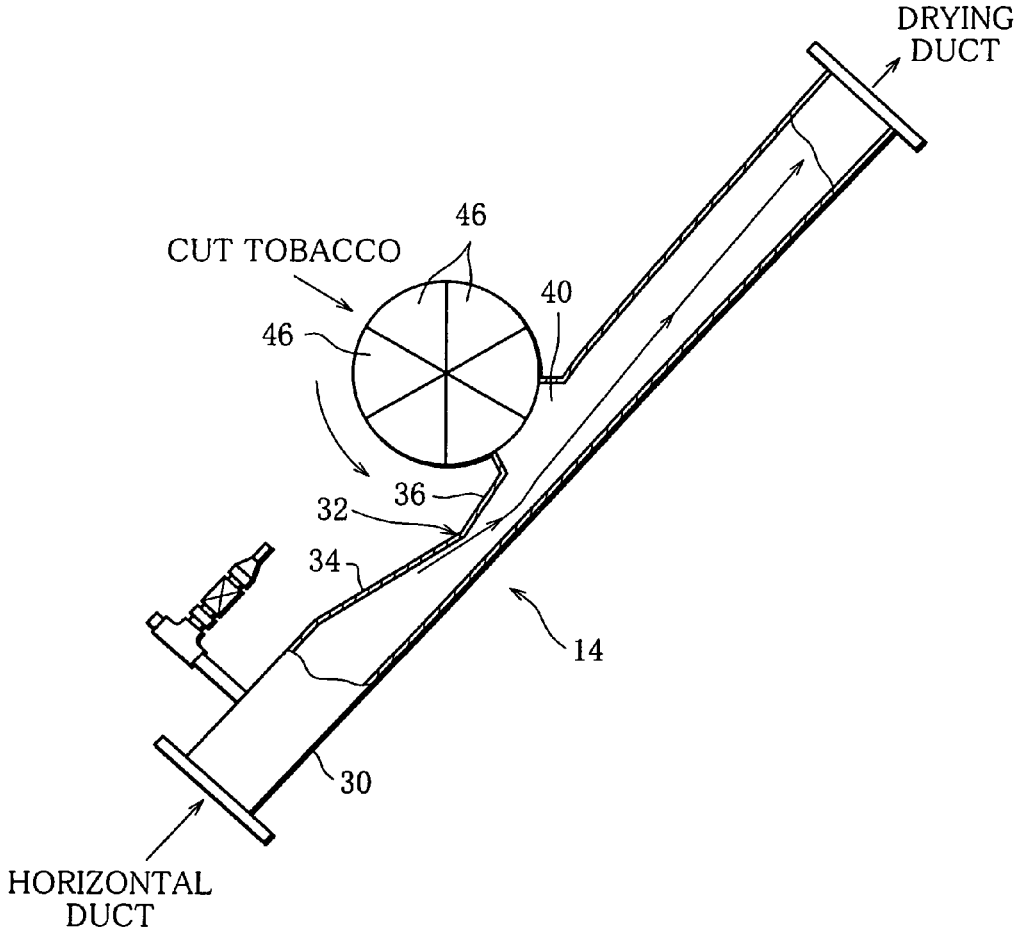
FIG. 5 is a cross sectional view of a modified venturi duct.

For instance, the feeding section 14 illustrated in FIG. 5, or the venturi duct 30, does not have the deep region 38, but has the bottom wall that linearly extends. Also in this case, since the dry gas flow that has passed through the throat 32 is so directed as to be separated away from the feed port 40, the supply of the cut tobacco from the feed port 40 into the venturi duct 30 is performed without difficulty. Moreover, even if the deep region 38 is not present, the flow-path cross-sectional area of the venturi duct 30 located downstream from the throat 32 is gradually increased toward the drying duct 16, so that the cut tobacco is satisfactorily dispersed.

Furthermore, the flash dryer of the present invention can be applied to the drying process of cut tobacco impregnated with liquid carbon dioxide as an impregnant.

Regarding the specification of the flash dryer in this particular case, only distinctions to the specification of the aforementioned flash dryer will be listed below.

Temperature of the dry gas (including the superheated steam): 160-400° C., preferably 250-380° C.

Oblique angle β: 0°

Moisture content of the dried cut tobacco: 2-9 wt %, preferably 2-7 wt %

When the dry gas contains no superheated steam, it is desirable that the dry gas have a temperature in the range of from 200 to 300° C. In this case, the moisture content of the dried cut tobacco is adjusted to be in the range of from 9 to 12 weight percent.

Additionally, the flash dryer is applicable not only to the drying of cut tobacco but also to that of many different particulate materials as well. Therefore, modification may be made in specific size, shape and the like of the drying duct 16, tangential separator 18, venturi duct 30, etc., according to particulate materials to be dried.

The invention claimed is:

1. A flash dryer for drying a particulate material comprising:

a gas flow path;

air-blowing means for producing a one-way dry gas flow in said gas flow path, the dry gas flow having a given temperature;

a feeding section disposed in said gas flow path and capable of feeding a particulate material to be subjected to a drying process into said gas flow path by means of the dry gas flow, the particulate material being transferred along with the dry gas flow and dried in the transferring process; and a separating section located in said gas flow path, downstream from said feeding section, said separating section including a tangential separator which has a horizontal axis for separating the dried particulate material from the dry gas flow and discharging the material from the gas flow path; the flash dryer wherein:

said gas flow path includes a drying duct for connecting said feeding section to said tangential separator and allowing the particulate material fed from said feeding section to smoothly flow toward said tangential separator together with the dry gas flow, without staying in the drying duct, wherein in order to minimize fracturing of the particulate material in the drying duct said drying duct includes:

a single upstream-side duct portion formed as a substantially straight member which is directly connected to a venturi of said feeding section, the single upstream-side duct portion sloping upwardly at a given elevation angle θ with respect to a horizontal plane, the given elevation angle θ with respect to a horizontal plane being adapted to generate a sharp rise in the dry gas flow; and a single downstream-side duct portion formed with a curved-shape having a uniform radius from one end of the curve to the other, the single downstream-side duct portion having an upstream end directly and smoothly connected to a downstream end of said upstream-side duct portion which extends upwardly at the elevation angle θ, and a downstream end directly and smoothly connected to a horizontally extending inlet at a top portion of a periphery of said tangential separator, wherein a length of the uniform curvature radius ranges from 6 to 20 m, and wherein the horizontally extending inlet of the tangential separator is located in a position at a higher level than a downstream end of the upstream-side duct portion, wherein the single downstream-side duct portion of said drying duct curves in a convex shape so that a curvature from the upstream end of the single downstream-side duct portion to the downstream end thereof is limited to an angle that is substantially equal to the elevation angle θ.

2. The flash dryer according to claim 1, wherein:

the elevation angle θ of said upstream-side duct portion ranges from 30° to 60°.

3. The flash dryer according to claim 1, wherein:

said feeding section includes:

a venturi duct slanted at the same elevation angle as that of said upstream-side duct portion of said drying duct and having a throat and a downstream portion, said downstream portion connecting said throat and said upstream-side duct portion of said drying duct and continuing linearly to said upstream-side duct portion; and a rotary feeder connected to said venture duct for supplying the particulate material into said venturi duct from a feeding position defined immediately downstream of said throat.

4. The flash dryer according to claim 3, wherein:

said venturi duct and said drying duct each have rectangular flow-path cross sections along longitudinal direction thereof; and the flow-path cross section of said venturi duct has width that is constant along the longitudinal direction thereof.

5. The flash dryer according to claim 4, wherein:

said throat is defined in between a bottom wall of said venturi duct and a part of a top wall of said venturi duct, the part of said top wall being formed in the shape of a substantial V in a longitudinal section thereof.

6. The flash dryer according to claim 5, wherein:

the bottom wall of said venturi duct has a downstream-side bottom portion downstream of said throat, the portion being formed in the shape of a substantial V in a longitudinal section thereof, and the downstream-side bottom portion defines a deep region that temporarily increases a flow-path cross-sectional area of said venturi duct.

7. The flash dryer according to claim 5, wherein:

the bottom wall of said venturi duct extends linearly.

8. The flash dryer according to claim 1, wherein:

said tangential separator comprises:

a cylindrical separator housing including an inlet disposed in a top portion of an outer periphery of said separator housing, being open in a horizontal direction, and leading the particulate material along with the dry gas flow from said drying duct, an outlet disposed in a bottom portion of the outer periphery of said separator housing, being open downward, and discharging said particulate material from said separator housing, an exhaust port opened in an end face of said separator housing eccentrically to the horizontal axis and discharging the dry gas from said separator housing, and a pair of linear wall portions forming the bottom portion of the outer periphery of said separator housing and facing each other so as to converge toward the outlet; and a rotary feeder connected to the outlet of said separator housing and takes out the particulate material from said separator housing through the outlet.

9. The flash dryer according to claim 8, wherein:

said separating section further includes chutes in plural tiers under said rotary feeder, said chutes being arranged in a line at given intervals in a vertical direction, and the particulate material taken out of said rotary feeder passes through said chutes sequentially while drawing in outside air from between said chutes.

10. The flash dryer according to claim 1, wherein:

the particulate material is cut tobacco for cigarettes; and the dry gas contains superheated steam and has a drying temperature in the range of from 160 to 260° C., absolute humidity in the range of from 2.4 to 11.8 kg/kg, and flow rate in the range of from 13 to 40 m/s in said drying duct to bring a moisture content of the cut tobacco, which has been dried, into the range of from 9 to 14 weight percent.

11. The flash dryer according to claim 1, wherein:

the particulate material is cut tobacco for cigarettes; and the dry gas contains superheated steam and has a drying temperature in the range of from 160 to 190° C. and absolute humidity in the range of from 2.4 to 11.8 kg/kg to bring a moisture content of said cut tobacco, which has been dried, into the range of from 12 to 14 weight percent.

12. The flash dryer according to claim 10, wherein:

said gas flow path forms a circulation passage of the dry gas; and said flash dryer further includes exhaust means for discharging at least 10 percent of flow rate of the dry gas from said circulation passage.

13. The flash dryer according to claim 1, wherein:

the particulate material is cut tobacco impregnated with liquid carbon dioxide; and the dry gas contains superheated steam and has a drying temperature in the range of from 250 to 380° C. and absolute humidity in the range of from 2.4 to 11.8 kg/kg to bring a moisture content of the cut tobacco, which has been dried, into the range of from 2 to 9 weight percent.

14. The flash dryer according to claim 1, wherein:

the dry gas has a drying temperature in the range of from 200 to 300° C. to bring a moisture content of cut tobacco, which has been dried, into the range of from 9 to 12 weight percent.

15. The flash dryer according to claim 13, wherein:

said gas flow path forms a circulation passage for the dry gas; and said flash dryer further includes exhaust means for discharging at least 10 percent of flow rate of the dry gas from said circulation passage.

16. The flash dryer according to claim 1, wherein a downstream portion of the receiving section and an upstream-side duct portion of the drying duct have a common axis which extends at an angle $\acute{\alpha}2$ with respect to an axis of an upstream portion of the feeding section.

17. The flash dryer according to claim 1, wherein a length of the drying path is 15 m.

18. The flash dryer according to claim 1, wherein the elevation angle θ of said upstream-side duct portion ranges from 30° to 60°, and wherein the single downstream-side duct portion is formed in a shape of an arc which curves uniformly from an upper end of the upstream-side duct portion having the elevation angle θ, to the inlet of the tangential separator where it is connected tangentially at an angle of 0° with respect to horizontal.

19. The flash dryer according to claim 1, wherein the single downstream-side duct portion is formed in a shape of an arc extending in range of at least 30° and not more than 60°.

20. A flash dryer for drying a particulate material comprising:

a gas flow path;

air-blowing means for producing a one-way dry gas flow in said gas flow path, the dry gas flow having a given temperature;

a feeding section disposed in said gas flow path and capable of feeding a particulate material to be subjected to a drying process into said gas flow path by means of the dry gas flow, the particulate material being transferred along with the dry gas flow and dried in the transferring process; and a separating section located in said gas flow path, downstream from said feeding section, said separating section including a tangential separator which has a horizontal axis for separating the dried particulate material from the dry gas flow and discharging the material from the gas flow path; the flash dryer wherein:

said gas flow path includes a drying duct for connecting said feeding section to said tangential separator and allowing the particulate material fed from said feeding section to smoothly flow toward said tangential separator together with the dry gas flow, without staying in the drying duct, wherein said drying duct includes:

a single upstream-side duct portion formed as a substantially straight member sloping upwardly from said feeding section and having a given elevation angle θ with respect to a horizontal plane; and a single downstream-side duct portion formed with a curved-shape having a uniform radius from one end of the curve to the other, the single downstream-side duct portion having an upstream end directly and smoothly connected to a downstream end of said upstream-side duct portion which extends upwardly at the elevation angle θ, and a downstream end directly and smoothly connected to a horizontally extending inlet at a top portion of a periphery of said tangential separator, and wherein a length of the uniform curvature radius ranges from 6 to 20m, and said feeding section includes:

a receiving section with a venturi duct, the venture duct including a throat with an upstream portion and a downstream portion, said downstream portion connecting said throat and said upstream-side duct portion of said drying duct and continuing substantially linearly to said upstream-side duct portion, wherein an angle between top and bottom walls along the upstream portion of the throat is smaller than an angle between the top and bottom wall along the downstream portion of the throat, and wherein the horizontally extending inlet of the tangential separator is located at a higher level than a downstream end of the upstream-side duct portion, wherein the single downstream-side duct portion of said drying duct curves in a convex shape, so that a curvature from the upstream end of the single downstream-side duct portion to the downstream end thereof is limited to an angle that is substantially equal to the elevation angle θ.

* * * * *